US007718839B2

(12) United States Patent
Baumgartner et al.

(10) Patent No.: US 7,718,839 B2
(45) **Date of Patent: *May 18, 2010**

(54) PROCESS FOR PRODUCING LOWER OLEFINS FROM HEAVY HYDROCARBON FEEDSTOCK UTILIZING TWO VAPOR/LIQUID SEPARATORS

(75) Inventors: Arthur James Baumgartner, Houston, TX (US); Danny Yuk-Kwan Ngan, Houston, TX (US)

(73) Assignee: Shell Oil Company, Houston, TX (US)

( * ) Notice: Subject to any disclaimer, the term of this patent is extended or adjusted under 35 U.S.C. 154(b) by 645 days.

This patent is subject to a terminal disclaimer.

(21) Appl. No.: 11/689,950

(22) Filed: Mar. 22, 2007

(65) Prior Publication Data

US 2007/0232845 A1 Oct. 4, 2007

Related U.S. Application Data

(60) Provisional application No. 60/786,956, filed on Mar. 29, 2006, provisional application No. 60/871,182, filed on Dec. 21, 2006.

(51) Int. Cl.
*C07C 4/02* (2006.01)

(52) U.S. Cl. ..... 585/648; 585/650; 585/652; 422/198; 208/128; 208/129; 208/130; 208/132

(58) Field of Classification Search ..... 208/128, 208/129, 130, 132; 422/198; 585/648, 650, 585/652

See application file for complete search history.

(56) References Cited

U.S. PATENT DOCUMENTS

| | | | | |
|---|---|---|---|---|
| 3,617,493 | A | 11/1971 | Wirth | 208/80 |
| 3,676,523 | A | 7/1972 | Mason | 260/683 |
| 3,928,170 | A | 12/1975 | Takahashi et al. | 208/40 |
| 4,062,758 | A | 12/1977 | Goudriann et al. | 208/80 |
| 4,169,782 | A | 10/1979 | Thompson | 208/102 |
| 4,257,871 | A | 3/1981 | Wernicke et al. | 208/57 |
| 4,264,432 | A | 4/1981 | Gartside | 208/48 R |
| 4,389,302 | A | 6/1983 | Garwin et al. | 208/86 |
| 4,428,823 | A | 1/1984 | Hessler et al. | 208/78 |
| 4,454,023 | A | 6/1984 | Lutz | 208/96 |
| 4,479,869 | A | 10/1984 | Petterson et al. | 208/130 |
| 4,615,791 | A | 10/1986 | Choi et al. | 208/107 |
| 4,615,795 | A | 10/1986 | Woebcke et al. | 208/72 |
| 4,773,986 | A | 9/1988 | Feldman et al. | 208/96 |
| 4,792,389 | A | 12/1988 | Frohn et al. | 208/76 |
| 5,580,443 | A | 12/1996 | Yoshida et al. | 208/130 |
| 5,582,711 | A | 12/1996 | Ellis et al. | 208/76 |
| 5,853,567 | A | 12/1998 | Gouzien et al. | 208/132 |
| 5,925,236 | A | 7/1999 | Fresing et al. | 208/131 |
| 5,980,732 | A | 11/1999 | Gillis | 208/210 |
| 6,048,448 | A | 4/2000 | Nirell | 208/67 |
| 6,376,732 | B1 | 4/2002 | Ngan et al. | 585/800 |

(Continued)

FOREIGN PATENT DOCUMENTS

| | | |
|---|---|---|
| EP | 249052 | 12/1987 |

(Continued)

*Primary Examiner*—Glenn Caldarola
*Assistant Examiner*—Prem C. Singh

(57) ABSTRACT

A process for making lower olefins from a heavy hydrocarbon feed by use of a combination of two vapor-liquid separation devices, and, then, pyrolytically cracking the light fraction of the heavy hydrocarbon feed to thereby produce a lower olefin product.

14 Claims, 3 Drawing Sheets

U.S. PATENT DOCUMENTS

| | | | | |
|---|---|---|---|---|
| 6,464,858 | B1 | 10/2002 | Brown et al. | 208/48 |
| 6,626,424 | B2 | 9/2003 | Ngan et al. | 261/112.1 |
| 6,632,351 | B1 | 10/2003 | Ngan et al. | 208/132 |
| 6,787,024 | B2 | 9/2004 | Siskin et al. | 208/48 R |
| 2004/0004028 | A1 | 1/2004 | Stell et al. | 208/130 |
| 2004/0054247 | A1 | 3/2004 | Powers | 585/652 |
| 2006/0089519 | A1 | 4/2006 | Stell et al. | 585/648 |

FOREIGN PATENT DOCUMENTS

| | | | |
|---|---|---|---|
| EP | 768363 | | 4/1997 |
| FR | 2768154 | | 3/1999 |
| GB | 1233795 | | 5/1971 |
| WO | WO 2005/113713 | A2 * | 12/2005 |
| WO | WO2006/037805 | | 4/2006 |

* cited by examiner

PROCESS FOR PRODUCING LOWER OLEFINS FROM HEAVY HYDROCARBON FEEDSTOCK UTILIZING TWO VAPOR/LIQUID SEPARATORS

This application claims the benefit of U.S. Provisional No. 60/786,956 filed Mar. 29, 2006 and U.S. Provisional Application No. 60/871,182 filed Dec. 21, 2006.

FIELD OF THE INVENTION

This invention relates to the processing of a heavy hydrocarbon feedstock to produce lower olefins.

BACKGROUND OF THE INVENTION

A common process for manufacturing lower olefins is through pyrolytic cracking of saturated hydrocarbon feedstocks containing hydrocarbons such as ethane, propane, butane, pentane, and crude oil fractions such as naphtha and gas oil. Producers of lower olefins are always looking for lower cost hydrocarbon feedstocks that can be economically upgraded by pyrolytic cracking processes to lower olefins. Lower cost materials that are of interest for the conversion to a lower olefins product are any paraffinic hydrocarbon material that contains high boiling point or non-vaporizable coke precursors such as crude oil and fractions of crude oil, such as petroleum residuum. While crude oil and petroleum residuum are attractive from a cost standpoint, they do not make good feedstocks for pyrolytic cracking, because they do not completely vaporize in the convection section of traditional pyrolytic cracking furnaces.

A recent advance in pyrolysis of crude oil and crude oil fractions containing pitch is shown in U.S. Pat. No. 6,632,351. In the '351 process a crude oil feedstock or crude oil fraction(s) containing pitch is fed directly into a pyrolysis furnace. The process comprises feeding the crude oil or crude oil fractions containing pitch to a first stage preheater within a convection zone, where the crude oil or crude oil fractions containing pitch are heated within the first stage preheater to an exit temperature of at least 375° C. to produce a heated gas-liquid mixture. The mixture is withdrawn from the first stage preheater, steam is added and the gas-liquid mixture is fed to a vapor-liquid separator, followed by separating and removing the gas from the liquid in the vapor-liquid separator, and feeding the removed gas to a second preheater provided in the convection zone. The preheated gas is then introduced into a radiant zone within the pyrolysis furnace, and pyrolyzed to olefins and associated by-products. While this is an improvement in the overall process, there are still limitations in achieving higher yields of more valuable products due to coke formation in the convection section and vapor-liquid separator at increased separation temperatures needed to increase hydrocarbon gas feed rates to the radiant section of the furnace where pyrolysis takes place.

U.S. Pat. No. 4,264,432 discloses a process and system for vaporizing heavy gas oil prior to thermal cracking to olefins, by flashing with steam in a first mixer, superheating the vapor, and flashing in a second mixer the liquid from the first mixer. Such a process is apparently directed to merely vaporization of heavy gas oils having an end point of about 1005° prior to pyrolysis cracking of the heavy oil, and is not directed to creating an acceptable pyrolysis feedstock from an otherwise unacceptable feedstock having undesirable coke precursors and/or high boiling pitch fractions.

What is needed is an improved process that permits the economical processing of a heavy hydrocarbon feedstock to produce lower olefins in higher yield, without causing unacceptable fouling or coking in the convection section or the vapor-liquid separation equipment.

SUMMARY OF THE INVENTION

The present invention relates to a process for pyrolyzing a portion of a heavy feedstock in order to provide a more economically attractive feed for the manufacture of olefins. This is accomplished by first separating an unvaporized portion of said feedstock containing undesirable coke precursors and/or high boiling pitch fractions that cannot be completely vaporized under convection section conditions of a typical pyrolysis furnace. The process that is claimed comprises:

a) feeding the feedstock to a first stage preheater provided in a convection zone of the pyrolysis furnace, and heating said feedstock within the first stage preheater to produce a heated gas-liquid mixture, b) withdrawing the heated gas-liquid mixture from the first stage preheater and combining it with high temperature steam in a first vapor-liquid separator, c) separating and removing the gas from the liquid in the first vapor-liquid separator, heating the gas in a vapor phase superheater provided in said convection zone to a temperature of about 450 to 700° C., feeding all or the majority portion (typically greater than 60% by volume) of the heated gas to a second vapor-liquid separator, and the remaining portion into a radiant zone of the pyrolysis furnace and pyrolyzing the gas to produce olefins and other pyrolysis products, d) withdrawing the liquid from the first vapor-liquid separator, and heating the removed liquid to a temperature of about 425 to about 510° C. by combining it with (i) the majority portion of the vapor from the first vapor-liquid separator after it is further heated in said superheater in the convection zone and optionally with (ii) additional superheated steam, and feeding the combined stream to a second vapor-liquid separator, e) separating and removing the gas components with normal boiling points below 590° C. from the liquid fraction in the second vapor-liquid separator, feeding the removed gas into a radiant zone of the pyrolysis furnace and pyrolyzing the gas to produce olefins and other pyrolysis products, and f) removing the remaining liquid fraction from the second vapor-liquid separator.

For some applications all that is required is one separator (e.g. cyclone), as disclosed and claimed in U.S. Pat. Nos. 6,632,351 and 5,580,443.

For example, for light feedstocks that contain pitch such as very light crude oil or black condensate, a single cyclone is all that is needed because relatively low cyclone temperatures, often less than 370° C. are required to almost completely vaporize the feedstock. Also, it is important to recognize that even for heavier feedstocks such as typical crude oils and short or long residue, if very high temperature dilution steam is readily available then only one cyclone is needed to avoid high feedstock temperatures in the convection section because the feedstock is only heated to temperatures where coke formation is possible outside of the convection section via its mixing with the high temperature steam. Where the two-cyclone concept of the present invention is especially helpful is in a design where very high temperature dilution steam is not readily available or there are coking problems created by mixing of a feedstock with very high temperature dilution steam or if the amount of dilution steam is limited. In these cases it is advantageous to use two cyclones to avoid heating of the feedstock in the convection section to very high temperatures so that a sufficiently high cyclone temperature can be achieved for maximizing vaporization of the desired hydrocarbons in the cyclone. Essentially, superheated vapor produced by heating vapor in the convection section that originated in the 1st cyclone is used in place of dilution steam or used to supplement dilution steam.

Typically, to achieve commercially acceptable pyrolysis furnace on-stream times, wide range boiling hydrocarbon feedstocks that contain pitch such as black condensates, crude oils and reduced (e.g., long residue or short residue) crude oils cannot be directly cracked in pyrolysis furnaces without first removing the pitch fraction. By incorporating one or more high efficiency cyclones in the convection section of the pyrolysis furnace, pitch-containing feedstocks can be fed directly to the furnace without prior fractionation, the cyclone(s) being used to remove the pitch fraction or to "bottom" the feedstock. The pitch stream removed from typical paraffinic feedstocks is relatively low in sulfur, metals and nitrogen and can be directly fed to either a residue FCC unit or a Coker or can be used as a fuel oil blending component.

The convection section of a pyrolysis furnace is especially well suited for the use of cyclone separators to bottom its feedstock since high feedstock temperatures and a large amount of high temperature steam are normally used for vaporization of heavy feedstocks in the convection section and a high steam/feed ratio is helpful to reduce coking in the radiant section. The incorporation of cyclone(s) does not necessarily require that additional heat transfer surface area in the convection section be installed or additional steam be used to vaporize the feedstock. High feedstock temperatures and the addition of large amounts of steam that are normally part of the ethylene furnace process can be used to achieve feedstock vaporization sufficient for separation of pitch with cut points up to ~1100-1200° F., (593-649° C.) and higher. Also, by incorporation of two cyclones in series with intermediate heating, extremely high pitch separation temperatures, in excess of 950° F., (510° C.) can be obtained without heating pitch-containing liquid fractions in the tubes of the convection bank beyond temperatures normally used in crude distilling unit charge heaters.

In addition, the process of the present invention is much cheaper and more energy efficient than building an additional distillation unit for bottoming pitch- containing feedstocks to recover the valuable hydrocarbons for pyrolysis. Use of two cyclones with intermediate heating of the vapor from the first cyclone also has the added advantage of being able to reduce the amount of dilution steam required for heating the feedstock.

DETAILED DESCRIPTION OF THE INVENTION

The heavy hydrocarbon feed (i.e. hydrocarbon feedstock containing undesirable coke precursors and/or high boiling pitch fractions that cannot be completely vaporized under convection section conditions) may comprise a range of heavy hydrocarbons. "Pitch" as used herein includes petroleum pitch and all other high boiling point heavy end fractions present in a feedstock that contain coke precursors or foulants. Examples of suitable feedstocks include, but are not limited to, one or more of long and short crude oil residues, heavy hydrocarbon streams from refinery processes, vacuum gas oils, heavy gas oil, and crude oil. Other examples include, but are not limited to, deasphalted oil, oils derived from tar sands, oil shale and coal, and synthetic hydrocarbons such as SMDS (Shell Middle Distillate Synthesis) heavy ends, GTL (Gas to Liquid) heavy ends, Heavy Paraffins Synthesis products, Fischer Tropsch products and hydrocrackate.

Figure 1:
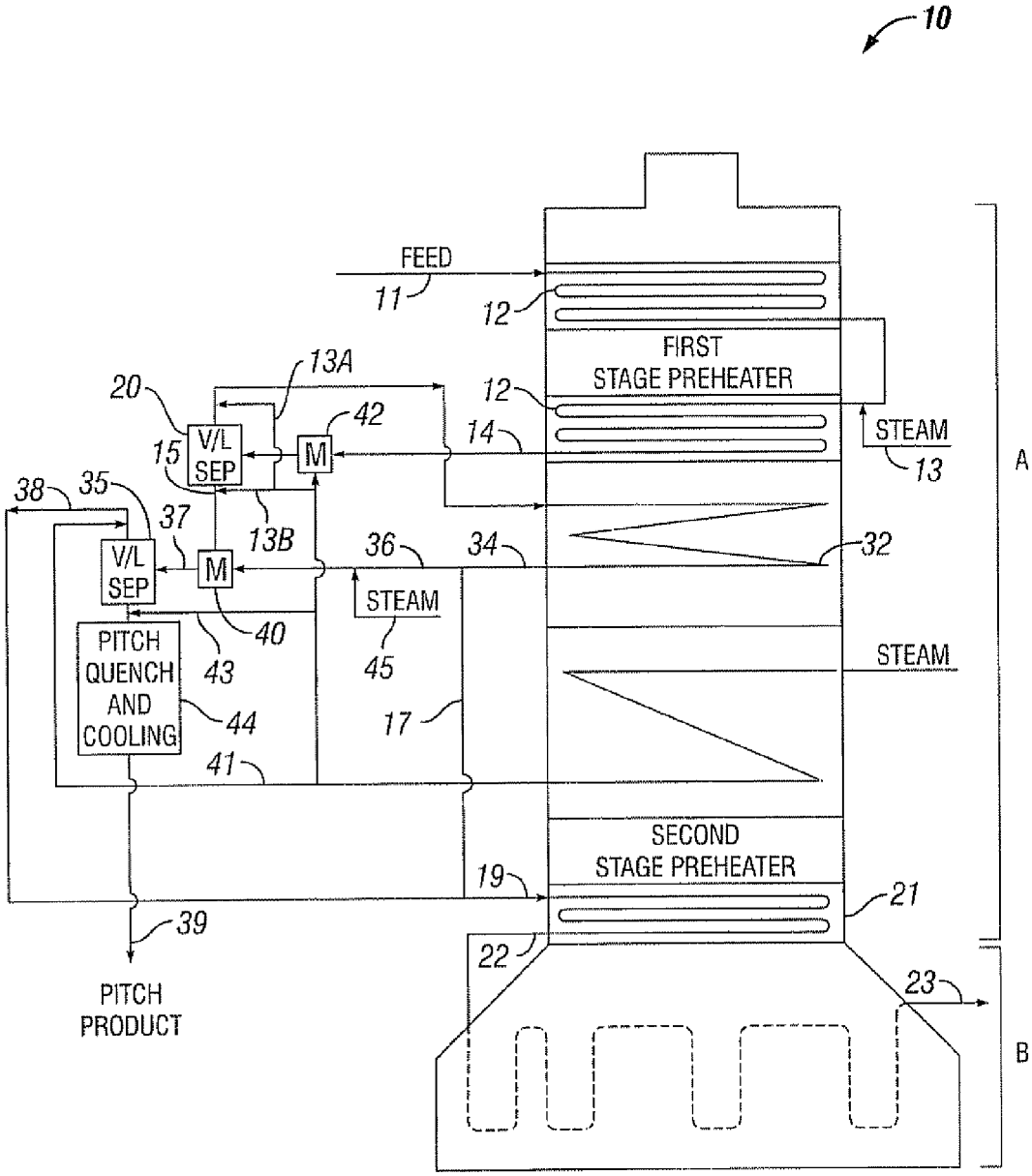
FIG. 1 is a schematic diagram representing the process flow of the preferred embodiment of the inventive process that utilizes two vapor-liquid separators and a single cracking furnace for heating the heavy hydrocarbon feed and for pyrolyzing the light fraction of the feedstock vaporized in the vapor-liquid separators.

The invention is described below while referring to FIG. 1 as an illustration of the invention. It is to be understood that the scope of the invention may include any number and types of process steps between each described process step or between a described source and destination within a process step. The olefins pyrolysis furnace 10 is fed with a desalted crude oil or crude oil fractions containing pitch 11 entering into the first stage preheater 12 of a convection zone A.

The first stage preheater 12 in the convection section is typically a bank of tubes, wherein the contents in the tubes are heated primarily by convective heat transfer from the combustion gas exiting from the radiant section of the pyrolysis furnace. In one embodiment, as the crude oil and/or long residue feedstock travels through the first stage preheater 12, it is heated to a temperature which promotes evaporation of the feedstock while leaving coke precursors in a liquid state. We have found that with a crude oil and/or long residue feedstock, it is desirable to fully evaporate the crude oil and/or long residue fractions that do not promote coking in the first stage preheater. As used herein, coking is meant to represent fouling by deposition of all forms of carbonaceous solids, including tars, coke and carbon. Maintaining a wet surface on the walls of the heating tubes substantially diminishes the coking phenomenon in the first stage preheater tubes. So long as the heating surfaces are wetted at a sufficient liquid linear velocity, the coking of those surfaces is inhibited.

Further inhibition of coking is obtained by limiting the temperature of the heating surfaces and all other surfaces that the liquid fractions that promote coking come into contact with. The optimal temperature at which the crude oil and/or long residue feedstock is heated in the first stage preheater of the convection zone so as to avoid temperatures of the heating surfaces that would result in accelerated coke deposition on them, will depend upon the particular crude oil and/or long residue feedstock composition, the pressure of the feedstock in the first stage preheater, and the performance and operation of the vapor-liquid separator(s). In one embodiment of the invention, the crude oil and/or long residue feedstock is heated in the first stage preheater to an exit temperature of at least 300° C., and more preferably to an exit temperature of at least 375° C. In other embodiments, the exit temperature of the feedstock from the first stage preheater is in the range of about 375° C. to about 525° C. Recognizing that the temperature of the crude oil and/or long residue feedstock inside the tubes of the first stage preheater changes over a continuum, generally rising, as the crude oil and/or long residue flows through the tubes up to the temperature at which it exits the first stage preheater, it is desirable to measure the temperature at the exit port of the first stage preheater from the convection zone. Tubing diameter, pressure and temperature are adjusted so that an annular flow regime is produced during the vaporization, thus keeping the wall of the tubing wetted.

The pressure within the first stage preheater 12 is not particularly limited. The pressure within the first stage preheater is generally within a range of 50 psig-400 psig, more preferably from about 60-180, psig.

To further inhibit the production and deposition of coke, especially in the radiant section of the furnace and to assist in the vaporization of liquid feedstocks in the convection section of the furnace, a dilution gas is fed to the furnace, most commonly to one or more portions of the feedstock heating and vaporization zones incorporated into the convection section of a pyrolysis furnace. In the embodiments described herein, the feed of dilution gas is a stream that is a vapor at the injection point into the first stage preheater. Any gas can be used which promotes the evaporation of the crude oil and/or long residue feedstock. The dilution gas feed injected externally also assists in establishing and maintaining the flow regime of the feedstock through the tubes whereby the tubes remain wetted and avoid a stratified flow. Examples of dilution gases are dilution steam, methane, nitrogen, hydrogen and natural gas. To further assist in feedstock evaporation the dilution gas can be supplemented with a typical light pyrolytic furnace feedstock such as ethane, propane, refinery off gas, and vaporized gasoline or naphtha. Preferably, the dilution gas is dilution steam. It is possible to use low temperature steam (meaning steam having a temperature of at least 149° C. (or 300° F.), which may or not be superheated steam) or even water if steam is not available. The amount of dilution steam or water added can vary widely.

In an optional but preferred embodiment of the invention, a feed of dilution steam 13 may be added to the crude oil and/or long residue feedstock in the first stage preheater at any point prior to the exit of the gas-liquid mixture from the first stage preheater, but preferably at the position in the preheater tubing just prior to where initial vaporization begins for the purpose of insuring an annular flow regime is quickly obtained in the preheater. In a more preferred embodiment, dilution steam is also added to the crude oil and/or long residue feedstock of the first stage preheater at a point external to pyrolysis furnace immediately downstream of the first stage preheater. Further, while a nozzle is not required, it is preferred that a mixing nozzle 42 be used to mix the steam and the feedstock. It is also preferred to add a further amount of superheated dilution steam 13A to the vapor outlet of the first stage vapor-liquid separator 20 in order to ensure that the vapor flowing to the downstream convection section bank is always above its dew point and no condensation of tars occurs on the walls of the piping connecting the vapor outlet of the separator and the downstream bank.

The temperature of the dilution gas is at a minimum sufficient to maintain the stream in a gaseous state. With respect to dilution steam, it is preferably added at a temperature above the temperature of the crude oil and/or long residue feedstock measured at the injection point to ensure that the dilution gas does not condense, more preferably at least 25° C. above the crude oil and/or long residue feedstock temperature at the injection point. The pressure of dilution gas is not particularly limited, but is preferably sufficient to allow injection over a wide range of feedstock flow rates. Typical dilution gas pressures added to the crude oil and/or long residue feedstock are within the range of 70-400 psig.

It is desirable to add dilution steam into the first stage preheater and/or downstream of it in an amount up to about 0.5 to 1.0 lbs. of steam per lb. of hydrocarbon feed being fed to the radiant section, although higher ratios can be used. Preferably the amount of steam should not be less than 0.25 lbs. of steam per lb. of hydrocarbon feed.

The percentage of vaporized components in a gas-liquid mixture within the first preheater may be adjusted by controlling the feedstock inlet temperature, the quantity of optional dilution steam added, and the temperature of optional superheated dilution steam added to the crude oil and/or long residue feedstock in the first stage preheater 12.

Figure 2:
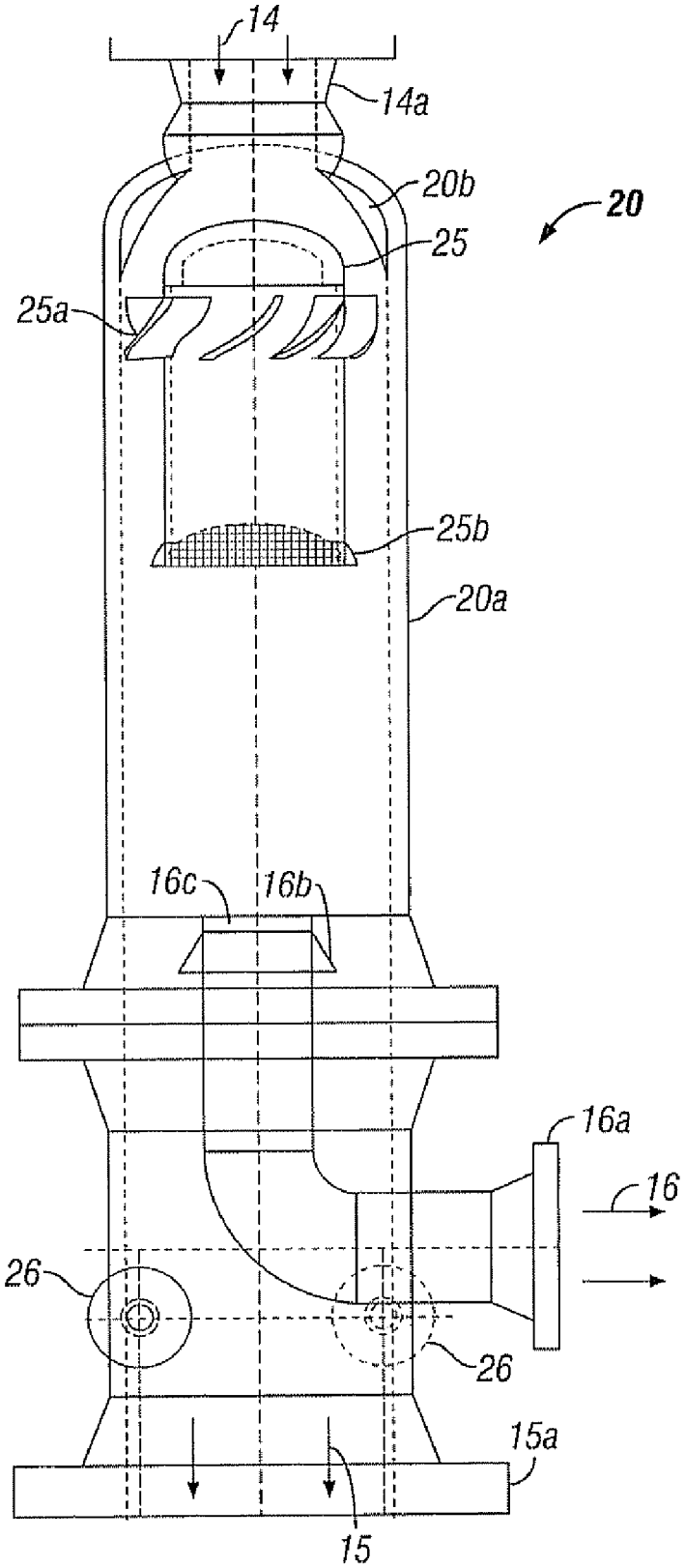
FIG. 2 is an elevation view of a vapor-liquid separator used in the invention.

Once the crude oil and/or long residue feedstock has been heated to produce a gas-liquid mixture, it is withdrawn from the first stage preheater through line 14 to mixing nozzle 42 and then to a vapor-liquid separator 20. The vapor-liquid separator removes the non-vaporized portion of the crude oil and/or long residue feed, which is withdrawn and separated from the vaporized gases of the crude oil and/or long residue feed. The vapor-liquid separator can be any separator, including a cyclone separator, a centrifuge, or a fractionation device commonly used in heavy oil processing. The vapor-liquid separator can be configured to accept side entry feed wherein the vapor exits the top of the separator and the liquids exit the bottom of the separator, or a top entry feed wherein the product gases exit the side of the separator such as shown in FIG. 2.

The vapor-liquid separator operating temperature is sufficient to maintain the temperature of the gas-liquid mixture within the range of 375° C. to 525° C., preferably within the range of 400° C. to 500° C. The vapor-liquid temperature can be adjusted by any means, including adjusting the temperature of the feedstock from the furnace, by use of external heat exchangers and/or by increasing the temperature and/or flow of the dilution steam routed to it. In a preferred embodiment, the vapor-liquid separator is described in U.S. Pat. Nos. 6,376,732 and 6,632,351 which disclosures are hereby incorporated by reference.

In the preferred embodiment, the vaporized gases from the first vapor-liquid separator 20 are then fed to a vapor superheater 32 in the convection zone of the pyrolysis furnace in order to increase the temperature of the stream from a typical temperature of about 427° C. to a maximum temperature not to exceed 677° C. A portion of the stream leaving the superheater, stream 34, shown as stream 17 in FIG. 1 may be routed, for temperature control of the second vapor-liquid separator, to the second stage preheater 21 to be pyrolyzed to olefins. The major portion of the stream leaving the superheater is routed to the second vapor-liquid separator 35 via lines 36 and 37. If desired, a small amount of steam may also be added to the stream leaving the superheater via line 45. The major portion of the vapor is mixed with the liquid 15 from the cyclone separator 20 in a mixing nozzle 40. Any mixing nozzle can be used, but preferably the mixing nozzle described in U.S. Pat. No. 6,626,424 should be used.

The second vapor-liquid separator may be similar to the first vapor-liquid separator, i.e. it may also be a cyclonic separator. As the intention of the second vapor-liquid separator is to remove components with normal boiling points less than 590° C. (or even higher boiling points depending on the type of feedstock) from the vapor-liquid mixture while at the same time minimizing the potential for fouling of the equipment, it is desirable to reduce the temperature of the liquid leaving the second vapor-liquid separator rapidly. Accordingly, a quench stream is used to rapidly reduce and control the temperature of the liquid leaving the second vapor-liquid separator. Although any type of vessel may be used to receive the liquid from the second vapor-liquid separator, it is preferred to use a vertical drum 44 located underneath the second vapor-liquid separator for that purpose and to control the temperature in this drum at about 320° C. which is generally accepted to be a temperature where no significant amount of thermal cracking will take place. In addition, the second vapor-liquid separator may be designed as a side-entry cyclone with a top outlet for the vapor and bottom outlet for the liquid and it may incorporate a bottom compartment for receiving the liquid, eliminating the need for a separate vessel to receive the pitch. In the preferred embodiment, a quench stream (not shown) is produced by withdrawing a portion of the liquid contained in the drum underneath the second cyclone, cooling it and recycling it to the drum. Rapid quenching is achieved by introducing the cooled recycled liquid into the top of the drum above the liquid level via a spray ring. The cooled recycled liquid can also be introduced back into the drum through a distribution ring immersed just below the surface of the liquid level. Hot vapor from the cyclone above is prevented from entering the drum and condensing on the 320° C. liquid by injection of a small flow of superheated dilution steam 43 into the top portion of the drum above the spray ring to form a vapor barrier between the drum and the cyclone.

The liquid product 39 from the second vapor-liquid separator will typically be fed to either a residue FCC unit or a Coker or can be used as a fuel oil blending component.

The advantage of having a second vapor-liquid separator is to be able to operate the first stage preheater at a modest outlet temperature, 375° C. or even lower and avoid any significant coking formation in it. An important added advantage is that the vaporized portion of the feedstock leaving the first vapor-liquid separator is readily recovered in the second vapor-liquid separator and it together with almost the entire amount of dilution steam injected into the furnace convection section are used as a lifting gas to promote the vaporization of components with normal boiling points less than 590° C. from the liquid leaving the first cyclone. The portion of the heated gas from the superheater routed to the second vapor-liquid separator is in the range of 60-100 volume percent of the heated gas and the portion of the heated gas routed to the second stage preheater is in the range of 0-40 volume percent. The lifting gas promotes vaporization of the components in the liquid phase by reducing the partial pressure of those components in the vapor phase and thereby allows them to vaporize at lower temperatures in much the same way that lowering the pressure of a single component liquid allows it to boil at a lower temperature. By maximizing the amount of lifting gas, the required operating temperature of the second vapor-liquid separator is minimized and accordingly the possibility of coke formation in the second vapor-liquid separator is also minimized. Still a further advantage of having two vapor-liquid separators is that it allows the vapor leaving the first vapor-liquid separator to be independently superheated in the convection section to a wide range of temperatures allowing the capability to achieve adequately high temperatures in the second vapor-liquid separator to recover most of the feedstock components having boiling points of less than 590° C. from the liquid leaving the first vapor-liquid separator.

Since the purpose of the second vapor-liquid separator is to remove vaporized light products, i.e. products whose normal boiling points are below 590° C. by use of a large amount of lifting gas, the temperature of the second vapor-liquid separator can be held typically much lower than 590° C., for example 480° C. or lower. When the first vapor-liquid separator is operated at 375 to 400° C., the second vapor-liquid separator could be operated in the range of 460 to 480° C. The range of operation of the second vapor-liquid separator will be typically between about 460° C. up to 500° C. with lower temperatures being preferred to minimize coke deposition or fouling of the equipment.

The heated steam/gas mixture exits the second vapor-liquid separator via line 38 and is superheated by the addition of a small amount of dilution steam 41. The mixture is then fed to the second stage preheater 21 and is heated in the second stage preheater as it flows through tubes heated by combustion gases from the radiant section of the furnace. In the second stage preheater 21, the superheated steam-gas mixture is fully preheated to near or just below a temperature at which significant feedstock cracking and associated coke deposition in the preheater would occur. The mixed feed subsequently flows to the radiant section B through line 22 of the olefins pyrolysis furnace where the gaseous hydrocarbons are pyrolyzed to olefins and associated by-products exiting the furnace through line 23. Typical inlet temperatures to the radiant section B are above 537° C., and at least 732° C. at the exit, more preferably at least 760° C., and most preferably between 760° C. and 860° C., to promote cracking of long and short chain molecules to low molecular weight olefins, i.e. olefins having carbon numbers in the range of 2-4. Products of an olefins pyrolysis furnace include, but are not limited to, ethylene, propylene, butadiene, benzene, hydrogen, and methane, and other associated olefinic, paraffinic, and aromatic products. Ethylene is the predominant product, typically ranging from 15 to 30 wt %, based on the weight of the vaporized feedstock.

The process of the invention inhibits coke formation within the vapor-liquid separators 20 and 35 and in the first stage preheater 21, by continually wetting the heating surfaces within the first stage preheater and surfaces inside the vapor-liquid separators and associated equipment upstream of the second stage preheater.

Pyrolytic cracking furnace 10 defines a pyrolytic cracking zone (the radiant section of the furnace) and provides means for pyrolytically cracking the hydrocarbons of the vaporized fraction of the feedstock to thereby yield a product rich in lower molecular weight olefins such as ethylene, propylene and butadiene. The lower olefin-rich product passes from pyrolytic cracking furnace 10 through conduit 23. As stated above, the pyrolytic cracking product comprises lower olefins but includes other derivatives.

As these terms are used herein, the light fraction comprises those hydrocarbon compounds that may suitably be used as feedstock for traditional pyrolytic cracking furnaces that are capable of vaporizing and pyrolytically cracking liquid hydrocarbon feedstocks. Such hydrocarbon compounds are generally those hydrocarbons that have normal boiling temperatures, meaning boiling temperatures at 14.696 psia of less than 590° C., more preferably less than 537° C., and are liquids at normal feedstock pressures required at the inlet of the first stage preheater. Feedstocks that have been derived directly by fractionation of crude oil and that predominately contain components with lower normal boiling points are usually more paraffinic in nature and tend to be better hydrocarbon feedstock with higher yields of lower olefins for pyrolytic cracking furnaces than heavier feedstocks derived from crude oil that contain components with higher normal boiling points. Also these feedstocks with lower normal boiling points can be easily processed in traditionally designed pyrolysis furnaces.

The pyrolysis furnace may be any type of conventional olefins pyrolysis furnace operated for production of lower molecular weight olefins, especially including a tubular steam-cracking furnace. The tubes within the convection zone of the pyrolysis furnace may be arranged as a bank of tubes in parallel, or the tubes may be arranged for a single pass of the feedstock through the convection zone. At the inlet, the feedstock may be split among several feed passes, each comprised of many straight tubes interconnected with U-bends, or may be fed to a single feed pass comprised of many straight tubes interconnected with U-bends through which all the feedstock flows from the inlet to the outlet of the first stage preheater. Preferably, the first stage preheater is comprised of one or more single pass banks of tubes disposed in the convection zone of the pyrolysis furnace. The second stage preheater may also be a single pass or multiple pass bank of tubes but preferably is a multiple pass bank so that its pressure drop is reduced and the residence time of hydrocarbons passing through it is minimized. In this preferred embodiment, the convection zone for heating and vaporizing of the feedstock comprises a single passage having one or more banks through which all of the crude oil and/or long residue feedstock flows, and a multiple pass bank for superheating of the portion of the feedstock that is to be pyrolyzed in the radiant section. In addition, a separate superheating bank is used for heating the vapor from the first vapor-liquid separator. Within each bank, the tubes may be arranged in a coil or serpentine type arrangement within one row, and each bank may have several rows of tubes.

To further minimize coking in the tubes of the first stage preheater and in tubing further downstream such as the piping leading to the vapor-liquid separator(s), the linear velocity of the crude oil and/or long residue feedstock flow should be selected to reduce the residence time of the liquid at high temperature as higher residence time promotes coke formation on the heated surfaces of the walls. An appropriate linear velocity will also promote formation of a thin liquid layer uniformly wetting the tube surface and provide sufficient shear force at the wall of the tubing to prevent or minimize the deposition of coke. While higher linear velocities of crude oil and/or long residue feedstock through the tubes of the first stage preheater reduce the rate of coke formation and deposition, there is an optimum range of linear velocity for a particular feedstock beyond which the beneficial rates of coke reduction begin to diminish in view of the extra energy requirements needed to pump the feedstock and the sizing requirements of the tubes to accommodate a higher than optimum velocity range.

One means for feeding a crude oil and/or long residue feedstock to the first stage preheater is through the use of any conventional pumping mechanism. In a preferred embodiment of the invention, the linear velocity of the crude oil and/or long residue feedstock is enhanced by injecting a small amount of liquid water into the feedstock downstream of the feed pump and prior to entry within the first stage preheater, or at any point desired within the first stage preheater. As the liquid water vaporizes in the crude oil and/or long residue feedstock, the velocity of the feed through the tubes increases. To achieve this effect, only small quantities of water are needed, such as 0.25 wt % water or less based on the weight of the feedstock through the first stage preheater tubes, but larger amounts can be used.

In many commercial olefins pyrolysis furnaces, the radiant section tubes accumulate sufficient coke every 3-5 weeks to justify a decoking operation of those tubes. The process of the invention provides for the preheating and cracking of a crude oil and/or long residue feedstock in a pyrolytic furnace without having to shut down the furnace for decoking operations of the convection section equipment any more often than the furnace would otherwise have to be shut down in order to conduct the decoking treatment in the radiant section tubes. By the process of the invention, the convection section run period is at least as long as the radiant section run period.

In another embodiment of the invention, the convection section tubes are decoked on a regular scheduled basis at a frequency as required, and in no event more frequent than the frequency of the radiant section decoking. Preferably, the convection section is decoked at a frequency at least 5 times longer, more preferably from at least 6 to 9 times longer than the radiant section decoking schedule. Decoking of tubing in the convection section and radiant section of the furnace may be conducted at the same time by including valves and piping to allow the outlet of the first stage preheater to be directed into the second stage preheater and by putting a flow of steam and air into the first stage preheater. From the second stage preheater the heated steam-air mixture will flow to the radiant section of the furnace and decoke it along with the first and second stage preheaters.

In the embodiments described herein, there is a flow of dilution steam that enters the convection section in a separate heating bank, preferably between the first and second stage preheaters, thereby superheating the flow of dilution steam to a temperature within a range of about 450° C. to 700° C., although higher temperatures can be used. Superheating of the dilution steam is preferred to assist in the vaporization of heavy feedstocks where vaporization temperatures in the first stage preheater are limited by maximum tubewall temperature required to minimize or prevent coke deposition in the first stage preheater.

In yet another embodiment of the invention, superheated dilution steam is added to the first stage preheater tubes and/or between the exit point from the first stage preheater of the convection section and the downstream vapor-liquid separator via a mixing nozzle 42 or device used to promote uniform liquid wetting of the tubing walls at the mixing point.

Referring to FIG. 2, the preferred vapor-liquid separator 20 comprises a vessel having walls 20*a*, an inlet 14*a* for receiving the incoming gas-liquid mixture 14, a vapor outlet 16*a* for directing the vapor phase 16 and a liquid outlet 15*a* for directing the liquid phase 15. Closely spaced from the inlet 14*a* is a hub 25 having a plurality of vanes 25*a*spaced around the circumference of the hub 25, preferably close to the end nearest the inlet 14*a*. The incoming gas-liquid mixture 14 is dispersed by splashing on the proximal end of the hub 25 and, in particular, by the vanes 25*a* forcing a portion of the liquid phase 15 of the mixture 14 outwardly toward the walls 20*a*of the vapor-liquid separator 20 thereby keeping the walls 20*a*completely wetted with liquid and decreasing the rate of, if not preventing, any coking of the interior of the walls 20*a*. Likewise, the outer surface of the hub 25 is maintained in a completely wetted condition by a liquid layer that flows down the outer surface of hub 25 due to insufficient forces to transport the liquid 15 in contact with the surface of hub 25 to the interior of the walls 20*a*. A skirt 25*b* surrounds the distal end of the hub 25 and aids in forcing all liquid transported down the outer surface of the hub 25 to the interior of the walls 20*a* by depositing said liquid into the swirling vapor. The upper portion of the vapor-liquid separator 20 is filled in at 20*b* between the inlet 14*a* and hub 25 to aid wetting of the interior of walls 20*a* as the gas-liquid mixture 14 enters the vapor-liquid separator 20. As the liquid 15 is transported downward, it keeps the walls 20*a* and the hub 25 washed and reduces, if not prevents, the formation of coke on their surfaces. The liquid 15 continues to fall and exits the vapor-liquid separator 20 through the liquid outlet 15*a*. A pair of inlet nozzles 26 is provided below the vapor outlet tube 16*a* to provide quench oil, typically recycled pitch that has been cooled to a non-reactive temperature for cooling collected liquid 15 and reducing downstream coke formation by ensuring surfaces underneath the nozzles are well irrigated with liquid. When this cyclone design is applied in the preferred process embodiment that incorporates two vapor-liquid separators, the nozzles 26 are used only in the second cyclone. They are not used in the first cyclone of that design since they would recycle pitch through the second cyclone again, reheating it to high temperatures and possibly causing it to become unstable. The vapor phase 16 enters the vapor outlet duct at its highest point 16*c*, exits at outlet 16*a*. A skirt 16*b* surrounds the entrance 16*c* to the vapor duct 16 and aids in deflecting any liquid 15 outwardly toward the separator walls 20*a*.

The distance of the hub 25 extension below the vanes 25*a* was picked based on estimation of the liquid drop size that would be captured before the drop had moved more than half way past the hub 25. Significant liquid 15 will be streaming down the hub 25 (based on observations with an air/water model) and the presence of a 'skirt' 25*b* on the hub 25 will introduce liquid droplets into the vapor phase well below the vanes 25*a*, and collection will continue below the skirt 25*b* of hub 25 due to the continued swirl of the vapor 16 as it moves to the outlet tube 16*a*. The hub skirt 25*b* was sized to move liquid from the hub 25 as close as possible to the outer wall 20*a* without reducing the area for vapor 16 flow below that available in the vanes 25*a*. As a practical matter, about 20% more area for flow has been provided than is present at the vanes 25*a*. Further details regarding sizing of the separator are disclosed in U.S. Pat. No. 6,632,351, which is hereby incorporated by reference.

Figure 3:
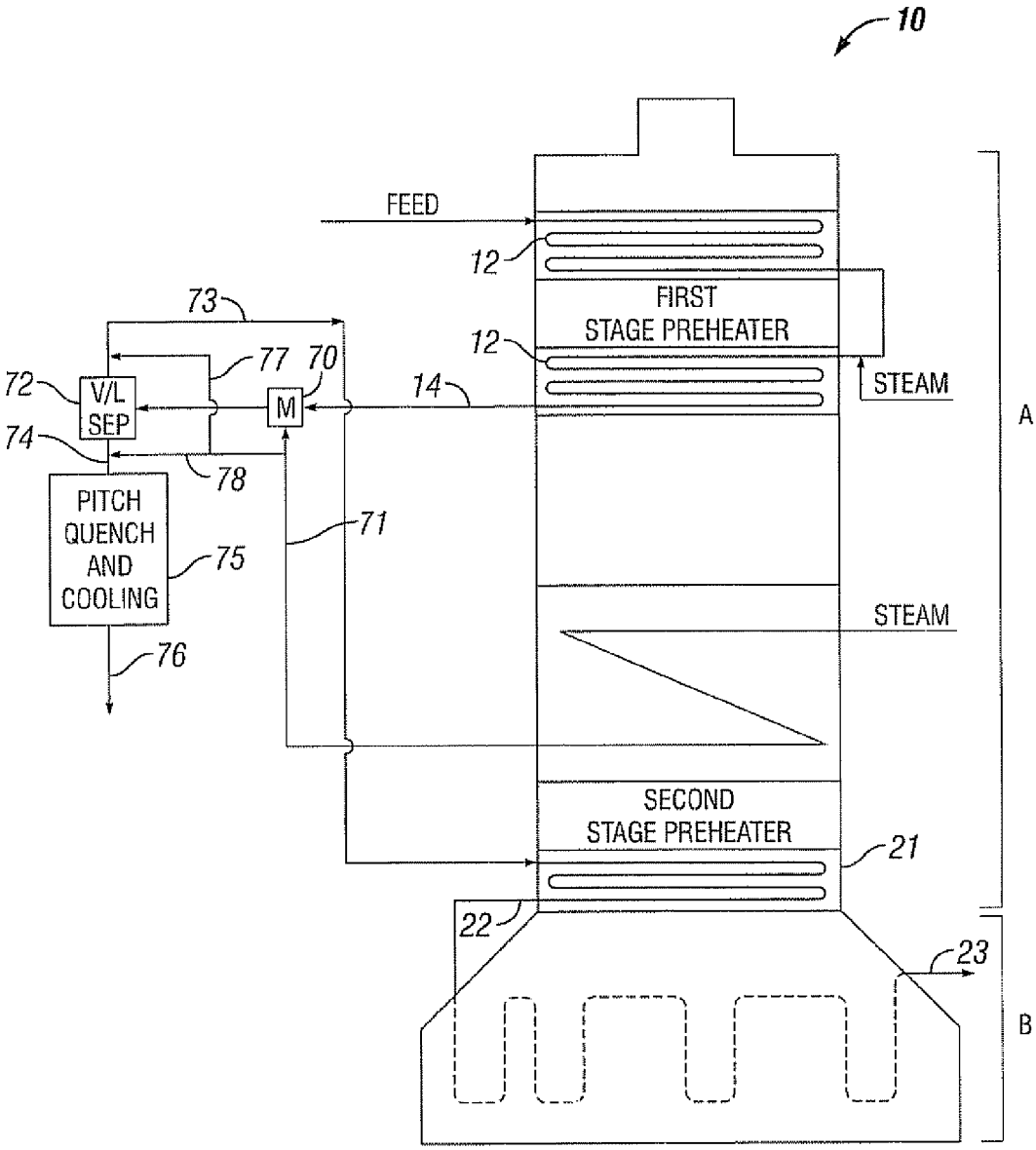
FIG. 3 is a schematic diagram employing a single vapor-liquid separator according to the prior art.

FIG. 3, relates to the use of a single cyclone separator, and is used for comparison to the present invention. Typically, the heated stream 14 from the first preheater 12 is routed to a mixing nozzle 70, where it is contacted with superheated dilution steam via line 71, and the heated vapor-liquid mixture is routed to a vapor-liquid separator 72, where the cracked vapors are recovered and leave the separator via line 73. The liquid is removed via line 74 to an accumulator drum 75, and the pitch is removed via line 76. Although not shown in FIG. 3, the temperature of pitch entering an accumulator drum underneath the cyclone is rapidly reduced to a non-reactive temperature of about 320° C. by introducing a cooled recycled liquid from the bottom of the drum into the top of the drum above the liquid level via a spray ring. To prevent hot vapors in the cyclone from leaving the bottom of the cyclone along with the liquid, a small amount of superheated steam is injected via line 78 into the vapor phase above spray ring in the accumulator drum which flows upward in countercurrent flow to the liquid flowing down from the cyclone. Superheated steam is injected via line 77 into the vapors leaving the cyclone to ensure the mixture is well above its dewpoint in interconnecting piping between the cyclone and the second stage preheater 21. The combined stream is routed via line 73 to the second stage preheater and exits the convection section of the furnace, A via the outlet line of that preheater, 22. From line 22 it enters the pyrolytic section, B of the furnace where it is heated and converted to produce olefins, which exit the furnace in line 23.

While this invention has been described in terms of the presently preferred embodiment, reasonable variation and modifications are possible by those skilled in the art. Such variations and modifications are within the scope of the described invention and appended claims.

That which is claimed is:

1. A process for vaporizing and pyrolyzing a portion of a hydrocarbon feedstock to olefins, and separating an unvaporized portion of said feedstock containing undesirable coke precursors and/or high boiling pitch fractions that cannot be completely vaporized under convection section conditions of a typical pyrolysis furnace, said process comprising:

a) feeding the hydrocarbon feedstock to a first stage preheater provided in a convection zone of a pyrolysis furnace, and heating said feedstock to an outlet temperature of less than 405° C. within the first stage preheater to produce a heated gas-liquid mixture, b) withdrawing the heated gas-liquid mixture from the first stage preheater, combining it with high temperature steam and feeding the combined stream to a first vapor-liquid separator, c) separating and removing the gas from the liquid in the first vapor-liquid separator, heating the gas in a vapor phase superheater provided in said convection zone to a temperature of about 450 to 700° C., feeding 60 to 100 volume percent of the heated gas to a second vapor-liquid separator, and the remaining portion into a radiant zone of the pyrolysis furnace and pyrolyzing the gas to produce olefins and other pyrolysis products, d) withdrawing the liquid from the first vapor-liquid separator, and heating the removed liquid to a temperature of about 425 to about 510° C. by combining it with the majority portion of the vapor from the first vapor-liquid separator after it is further heated in said superheater in the convection zone and feeding the stream to a second vapor-liquid separator, e) separating and removing the gas from the liquid fraction in the second vapor-liquid separator, feeding the removed gas into a radiant zone of the pyrolysis furnace and pyrolyzing the gas to produce olefins and other pyrolysis products, and f) removing the remaining liquid fraction from the second vapor-liquid separator.

2. The process of claim 1 wherein pyrolytic cracking conditions include a pyrolytic cracking temperature of from about 700° C. to about 900° C., a pyrolytic cracking pressure of from about 15 psia to about 45 psia, and wherein the gaseous fractions are exposed to the pyrolytic cracking conditions within the radiant zone for a pyrolytic cracking time period upwardly to a maximum of about 10 seconds.

3. The process of claim 1 wherein said vapor-liquid separators are centrifugal vapor-liquid separators.

4. The process of claim 1 wherein superheated dilution steam is added to the heated gas-liquid mixture from the first stage preheater in a mixing nozzle.

5. The process of claim 1 wherein said hydrocarbon feedstock is selected from the group consisting of long and short crude oil residues; vacuum gas oil; heavy gas oil; crude oil; deasphalted oil; oils derived from tar sands, oil shale and coal; SMDS (Shell Middle Distillate Synthesis) heavy ends; GTL (Gas to Liquid) heavy ends; Heavy Paraffins Synthesis products; Fischer Tropsch products; hydrocrackate; and mixtures thereof.

6. The process of claim 1 wherein the temperature of the liquid removed from the second vapor-liquid separator is adjusted to a maximum temperature of about 320° C. to control the stability of the liquid, such that the time-temperature history of the liquid does not exceed that which cause asphaltenes to precipitate in the liquid.

7. The process of claim 1 wherein the amount of remaining liquid fraction from the second vapor-liquid separator is adjusted such that enough liquid is left to wet and wash the surfaces of the separator.

8. The process of claim 6 wherein the temperature in the second vapor-liquid separator is controlled to a temperature of between 460 and 500° C. by adjusting the temperature and the amount of superheated dilution steam added to the liquid feed to the second vapor-liquid separator.

9. The process of claim 6 wherein the temperature in the second vapor-liquid separator is controlled by adjusting the temperature of the liquid entering the second vapor-liquid separator.

10. The process of claim 6 wherein the liquid removed from the second vapor-liquid separator is rapidly cooled.

11. The process of claim 1 wherein high temperature dilution steam is added to: a) the vapor outlet of the first and the second vapor-liquid separators, and b) the liquid outlets of the first and second vapor-liquid separators.

12. The process of claim 1 wherein the total amount of dilution steam added is between 0.25 and 1.0 pounds of steam per pound of feedstock.

13. The process of claim 1 wherein steam and/or liquid water is added to the feedstock at the inlet to the first stage preheater and/or after the inlet to the first stage preheater in order to increase velocity in the preheater tubes, and ensure that the flow is in the annular flow regime, ensuring wetted walls.

14. The process of claim 8 wherein liquid water is added to the high temperature dilution steam to control the temperature of the steam to between 530 and 700° C.

* * * * *